United States Patent [19]

Spear

[11] Patent Number: 4,932,170

[45] Date of Patent: Jun. 12, 1990

[54] VALUTED SUB-CEILING ILLUMINATION SYSTEM

[76] Inventor: Matthew L. Spear, 290 23th Ave., NW., New Brighton, Minn. 55112

[21] Appl. No.: 373,408

[22] Filed: Jun. 30, 1989

[51] Int. Cl.[5] ..... E04B 5/55; E04B 5/62

[52] U.S. Cl. ..... 52/28; 52/86; 52/484; 362/150

[58] Field of Search ..... 52/16, 28, 86, 488, 52/484; 362/147-150

[56] References Cited

U.S. PATENT DOCUMENTS

| | | | |
|---|---|---|---|
| 248,174 | 9/1949 | Stitt | 52/484 |
| 2,734,127 | 2/1956 | Naysmith | 362/150 |
| 2,978,758 | 4/1961 | Dunn | 52/16 |
| 3,035,672 | 5/1962 | Tuten et al. | 52/44 |
| 3,545,145 | 12/1970 | Yousefpor | 362/150 |
| 3,743,826 | 7/1973 | Halfaker | 362/14 |
| 3,941,995 | 3/1976 | Fritz | 362/147 |
| 3,965,624 | 6/1976 | Modanna | 362/147 |

FOREIGN PATENT DOCUMENTS

| | | | |
|---|---|---|---|
| 642430 | 5/1928 | France | 52/44 |
| 958859 | 9/1949 | France | 52/4 |
| 301703 | 6/1968 | Sweden | 52/44 |

*Primary Examiner*—James L. Ridgill, Jr.

*Attorney, Agent, or Firm*—Douglas L. Tschida

[57] ABSTRACT

A rigid ceiling system including a plurality of gridwork members supported solely from the walls of a room and further including a plurality of vaulted translucent diffusion panels. Notched rib members including indexing brackets align each panel to the formed gridwork. Wall mounted illumination sources provide desired lighting relative to the diffusion panels.

7 Claims, 5 Drawing Sheets

VALUTED SUB-CEILING ILLUMINATION SYSTEM

BACKGROUND OF THE INVENTION

This present invention relates to room ceiling and illumination systems and in particular to exposed sub-ceiling systems supported only from mountings at the wall or soffit and wherein an associated rigid frame work supports translucent diffusion panels beneath wall, soffit or ceiling mounted fluorescent light fixtures.

When designing an illumination system for a room, the challenge is to provide the right amount of light, in the right places, as efficiently as possible. Some situations call for intense light to be directed over side perimeter work spaces, while requiring less intense ambient light throughout the remainder of the room. The typical domestic kitchen is the most common example of such a design.

One or more centrally located ceiling mounted light fixtures is most common solution. Although providing general ambient light, such fixtures do not beneficially illuminate perimeter counter space and instead create shadows on the work surface. Work related injuries can result and/or eye strain.

Alternative recessed, track, or under cabinet lighting may be difficult and/or expensive to install in a remodeling situation, due to difficulties of concealing the electrical wiring to each fixture. That is, proper installation requires that the wiring be concealed. These types of systems are also not efficient because they provide such localized lighting that several fixtures are often times required to provide a desired coverage for the perimeter work surfaces.

Another solution is a suspended ceiling system with fluorescent light modules supported by an inverted T-grid framework. Typically, such systems are installed to lower the effective ceiling level by approximately one (1) foot. This reduces the typical eight foot high ceiling to a seven foot, which significantly reduces total room volume and produces a confined environment. These systems however tend to be heavy, and require several suspension wires to be attached to eyelets or other fasteners that must be screwed directly into the room ceiling. The decision to install a suspended ceiling system in an established room must therefor be considered a relatively permanent change, due to the resulting damage to the original ceiling surface.

Whatever the precise merits, features and advantages of the above cited systems, none of them achieves or fulfills the purposes of the present invention.

SUMMARY OF THE INVENTION

It is the primary object of the present invention to provide intense light over the perimeter working spaces of a room, while maintaining an appropriate level of ambient room light and reducing the detrimental affects of shadows.

Further objects of the invention are that relatively few and/or relatively inexpensive light fixtures be required; that the ceiling height in the center of the room not be significantly reduced; that ceiling mounted fixtures, not be required; that no fastenings be made to the existing finished ceiling surface; and that the electrical wiring be concealed, as by installation in the space above the installed sub-ceiling or behind exposed wall, soffit, cabinet, or ceiling surfaces.

In fulfillment of the above objects, the present invention provides for a few relatively long fluorescent light fixtures (i.e. four to eight foot shop lights) which are mounted exclusively to the soffit or wall along at least two sides of the room. These fixtures are installed end-to-end such that they run the full length or width of the room, directly over the perimeter work surfaces.

The ceiling system otherwise comprises right angled or T-shaped grid members tracks which are mounted exclusively to the lower interior edges of a provided soffit or to the wall at a desired distance from the ceiling. The outer ends of long inverted T-bars and short, cross T-bars are, in turn, suspended from the perimeter track to form a rigid grid framework which supports a number of translucent diffusion panels along each side relative to the light fixtures. Arched ribs span a central space between perimeter panels and support still other translucent diffusion panels which conform to the curvature of the ribs. The arched panels are indexed to the ribs with locating tabs and the ends of the ribs are secured to the grid framework.

DESCRIPTION OF THE INVENTION

Figure 1:
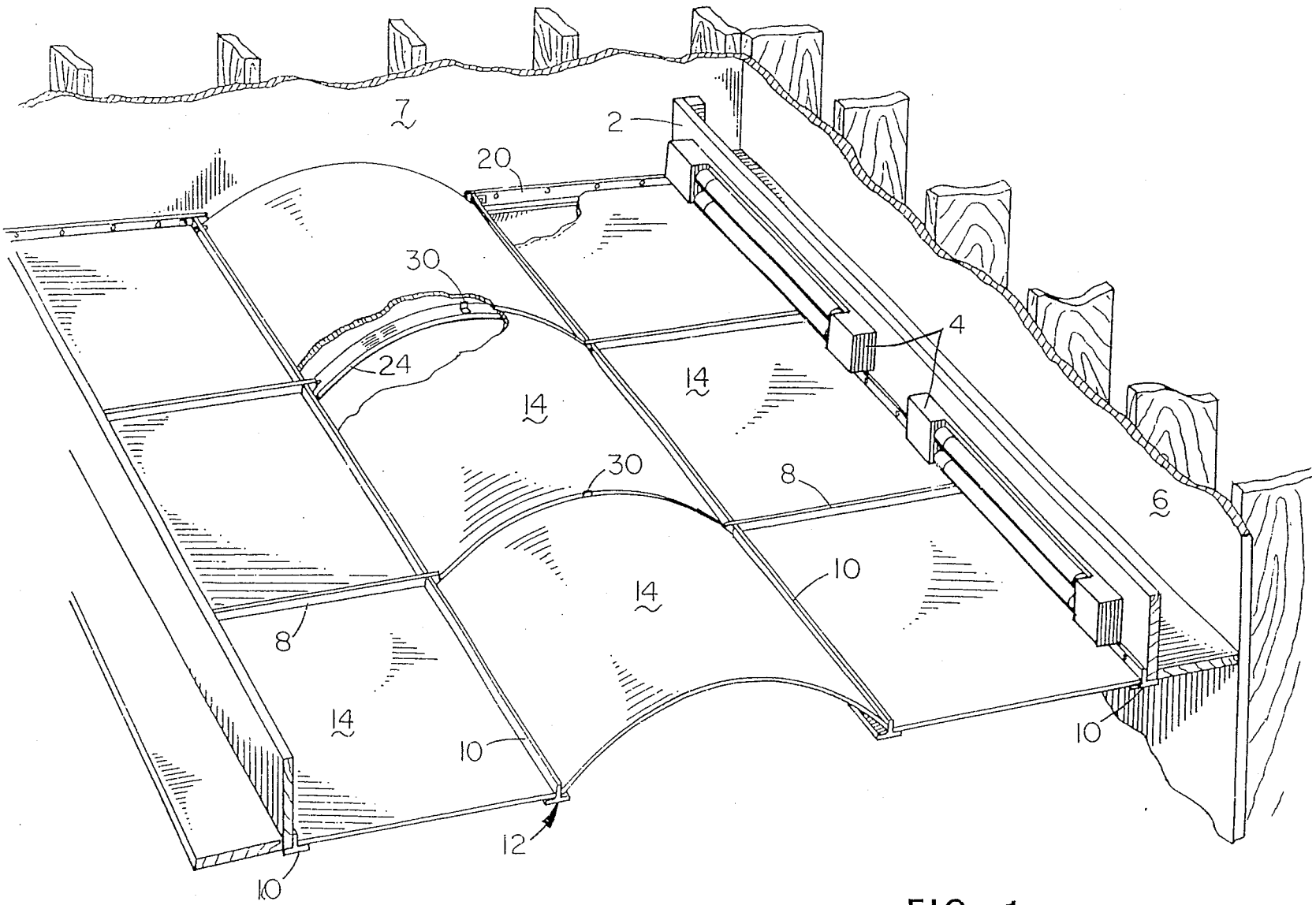
FIG. 1 shows an isometric view from a point above the ceiling system of the preferred embodiment of the invention for a soffited installation.
Figure 2:
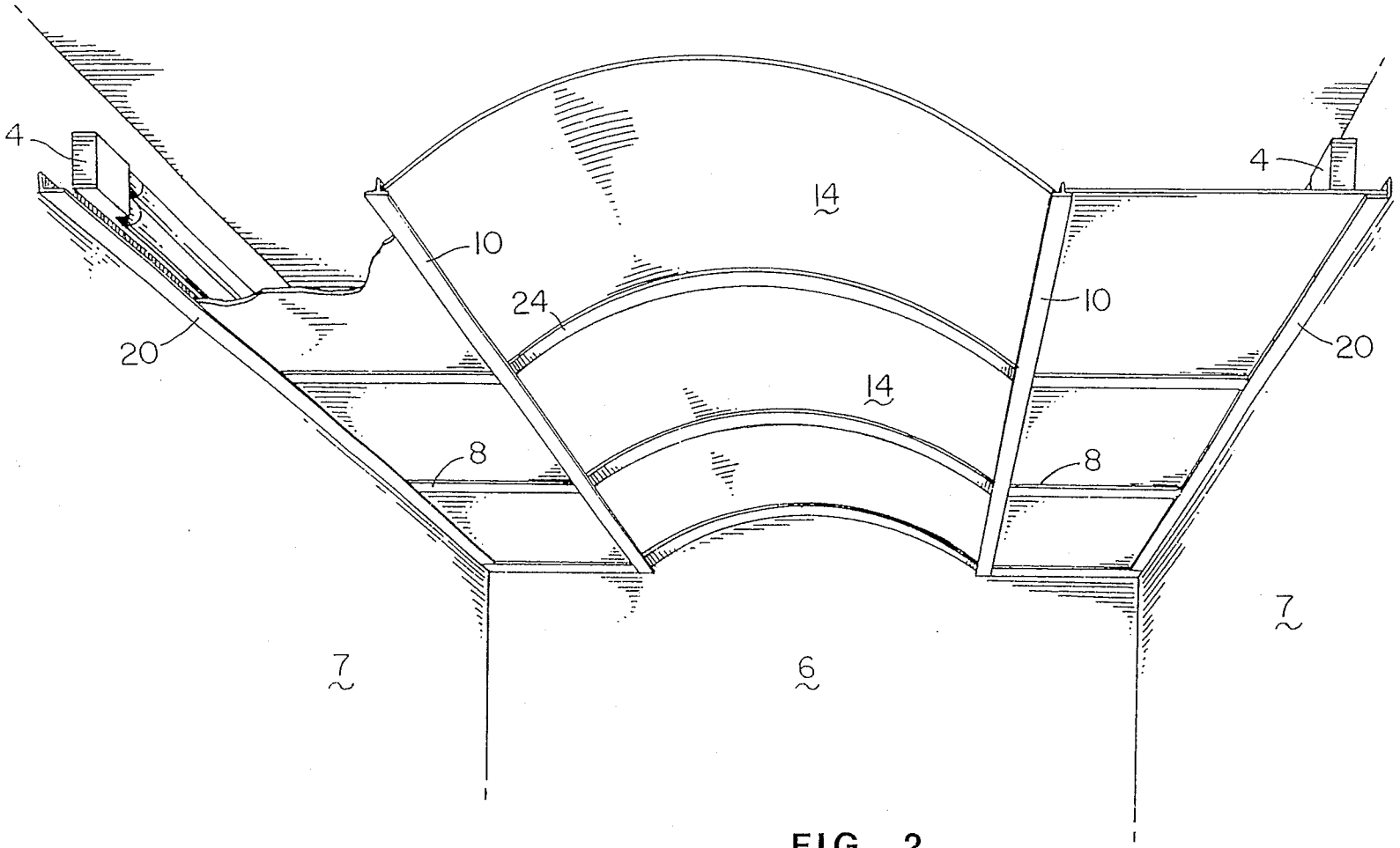
FIG. 2 shows an isometric view from a point beneath a wall mounted installation.

Referring to FIG. 1, an isometric view is shown of the preferred embodiment of the invention from a viewing point above the installed system, with the ceiling removed. Mounted, end-to-end along and to the right soffit 2 are a number of fluorescent light fixtures 4, only two of which are shown, but which run the entire length of the opposite sides of the room. Additional fixtures 4 can also be secured to the end wall 6 or where soffits aren't provided, as in FIG. 2, directly to the side walls 7. The number and positioning of the fixtures 4 thus can be varied as desired. White two tube, four foot long shop fixtures have been found to work best, alternatively eight foot fixtures can be used.

The fixtures 4 are installed approximately one and one-half inches above the bottom edge of the soffit 2 which provides sufficient clearance for the grid members 8 and 10 of the sub-ceiling framework 12, while providing light directly over the side perimeter work spaces. Conventional mountings and wiring techniques are used to secure and make the fixtures 4 operational. Typically, too, the power for the fixtures 4 is derived from a junction box (not shown), which supplies power to a center-positioned room light, and which is no longer required once the present illumination system is added.

Figure 3:
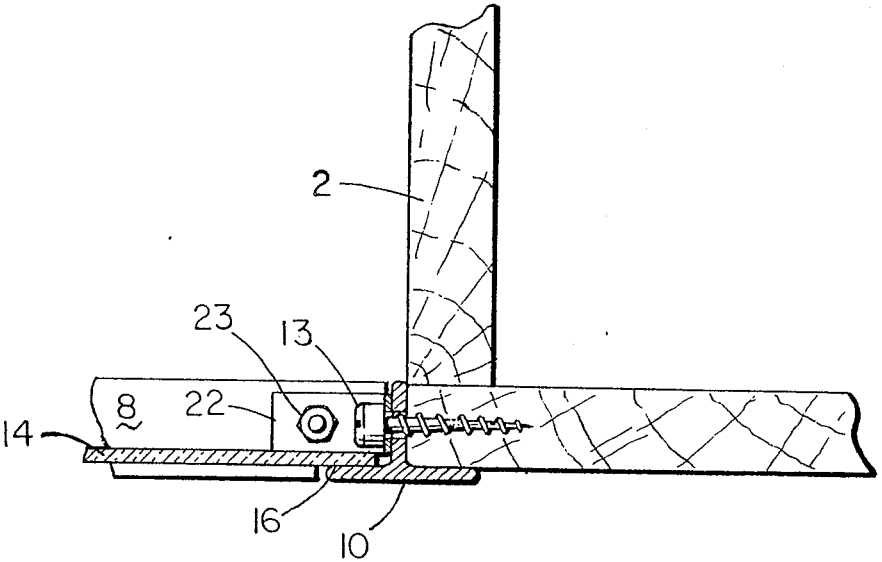
FIG. 3 shows a detailed view of the proper positioning of a perimeter T-member when mounted to a soffit.

With additional attention to FIG. 3, secured to the bottom edge of each soffit 2 are appropriate lengths of the relatively long, rigid T-members 10. The members 10 are particularly secured to the soffit 2 with screws 13, nails, or the like. When mounted in the fashion shown, the exposed face of each member 10 hides the soffit edge, yet provides an inner ledge 16 to support a plurality of cross T-members 8 and translucent panels 14 placed thereover.

If no soffit 2 exists on one or both side walls 6, such as at the end wall 7, right angle support members 20 (only one of which is shown) are installed at an equal distance from the ceiling surface as the bottom of the soffit 2. See also the detailed cross-section view of FIG. 4 wherein a side wall 6 does not support a soffit 2. Otherwise, the ends of the T-members 10 which extend parallel to the soffits 2 are supported at their ends from the members 20 secured to the end walls 7.

Cross T-members 8 are supported at two or four foot intervals in perpendicular relation to the soffits 2. Their outer ends rest on the ledge 16 and their inner ends interlock to the adjacent T-members 10. That is, a protruding end portion 9 of each cross T-member 8 is insertable through a slot 11 in each T-member 10, reference FIGS. 4 and 6. Normally the ends 9 are then bent flush against the vertical web 21 of the T-members 10. In the present invention, however, the ends 9 interlock with rib members 24 in a fashion to be described below.

Although the outer ends of the T-members 8 and 10 need respectively only rest on the ledge 16 of the wall mounted members 20 and soffit mounted T-members 10, in the present system it is preferable that they be rigidly secured thereto. In this regard and with attention to FIGS. 3, 4 and 5 a right angle bracket 22 is respectively secured with screw fasteners 23 and 13, to the vertical web 21 of each T-member 8 and 10 and to each member 20 or 10. The system is thereby made more rigid, with the ends of each of the T-members 8 and 10 being firmly secured to the soffits 2 and walls 6, 7.

Figure 4:
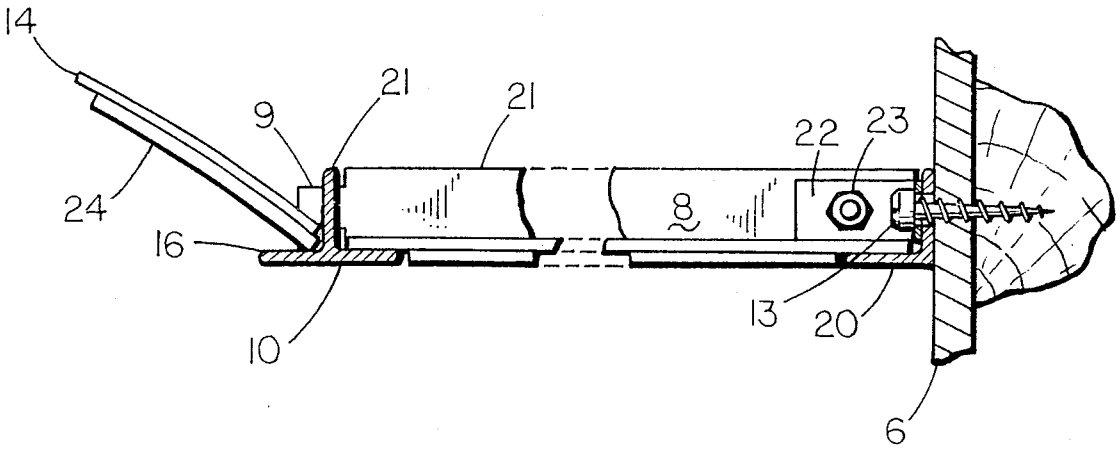
FIG. 4 shows a cross-section view of the positioning of a perimeter angle member when mounted to a wall, along with the mounting of a vaulted rib member to the framework.
Figure 5:
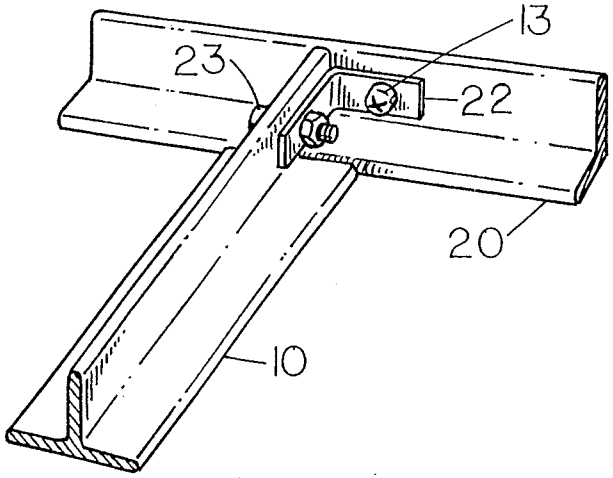
FIG. 5 shows an isometric view of the manner of attachment one of the primary T members to a perimeter support member.
Figure 6:
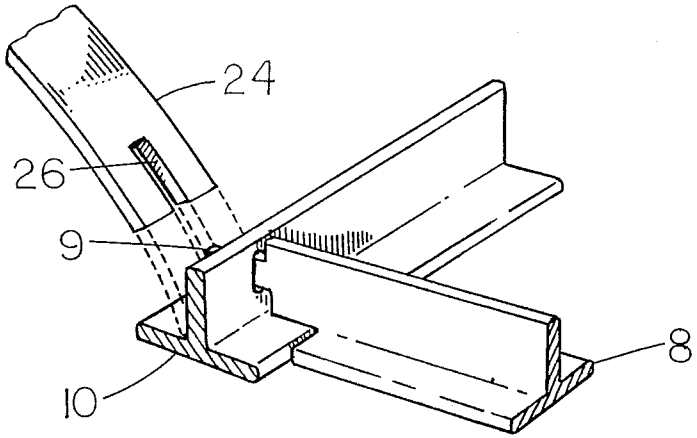
FIG. 6 shows an exploded isometric view of the mounting of the arched ribs to the grid framework.

Referring to the cutaway portion of FIG. 1 and also to FIGS. 4 and 6, a plurality of nominal one sixteenth inch thick, one inch wide, aluminum flat stock rib members 24 are cut to desired length and inserted between the inner T-members 10 to align with the cross members 8 to create a arched or vaulted support surface for ones of the plurality of translucent panels 14. Typically, the arched ribs 24 are cut six inches longer than the span between the adjacent T-members 10 which usually provides sufficient arc to accommodate an available one foot of head room below the ceiling. The goal being to trial fit the rib members 24 to assure sufficient clearance between the top center of the arched ribs 24 and the ceiling surface sufficiently so as not to interfere with any interviewing structures. The vaulting of the panels 24 not only provides an accent feature to the sub-ceiling, but also serves to diffuse the light from the fixtures 4 to the center areas of the room.

Let into the opposite ends of each ribs are one sixteenth inch wide, three eighths inch long slots 26, one of which is shown in the exploded assembly view of FIG. 6. Except for the two end ribs 24, the slots 26 of each rib 24 locates over the protruding tab ends 9 of each cross T-member 8.

Adhesively bonded midway along the length of each rib member 24 to its unexpected surface is an angle bracket 30. Two brackets 30 are otherwise secured to the end rib members 24, approximately one third the length from each end of the rib 24. The brackets 30 of the two end ribs are screw. fastened to the adjacent soffit 2 or wall 6 or 7 at the natural arc established when the ribs are positioned and serving as an indexing means. Adjustment can be made as necessary to assure that all ribs 24 align to form a uniform vaulted surface.

Once all the rib members 24 are positioned, the panels 14 are positioned between the ribs 24. Each panel 14 is cut to a comparable length of each rib members 24 to exhibit the same arc. Otherwise the panels 14 are generally flexible enough to mate with the rib members 24 by virtue of their inherent weight. Clips (not shown) can also be used at each member 10 to prevent the ends from lifting from the ribs. Proper lateral alignment is assured by virtue of the angle brackets 30 along with the tabs 9, notches 26 and web 21 of each T-member 10 which properly locate the arched diffusion panels 14 relative to each other.

While the present invention as been described with respect to its presently preferred embodiment, it is to be appreciated still other constructions might suggest themselves to those of skill in the art upon exposure hereto. Accordingly, the following claims should be interpreted to include all those equivalent embodiments within the spirit and scope of the forgoing described invention.

What is claimed is.

1. A sub-ceiling system comprising;

(a) a plurality of flourescent illumination means;

(b) a gridwork comprised of a plurality of framework members extending between the walled surfaces of a room and interconnecting with one another to provide a support matrix having a plurality of apertures, wherein ones of said framework members exhibit a right angled cross sectional shape and others of said support members exhibit a T cross sectional shape;

(c) a plurality of translucent panels supported in ones of said apertures of said gridwork;

(d) a plurality of rib members supported in arcuate relation within at least one of said apertures; and (e) means for supporting at least one of said translucent panels in indexed relation to said rib members.

2. Apparatus as set forth in claim 1 wherein said indexing means comprises a plurality of right angled members secured to an unexposed surface of said rib members.

3. Apparatus as set forth in claim 1 wherein the peripheral framework members of said gridwork are secured solely to the walled surfaces and a plurality of said T shaped framework members substantially span said room and are rigidly secured at their opposite ends to said peripheral framework members and said walled surfaces.

4. Apparatus as set forth in claim 1 including a plurality of relatively short T shaped framework members secured at at least one end through an aperture in a relatively long, transversely mounted T member extending between opposite walled surfaces and wherein each end of said rib members is notched to mount about the end of one of said T members.

5. Apparatus as set forth in claim 1 wherein each of said plurality of rib members exhibits an exposed width substantially the same as each of said T members.

6. A sub-ceiling system comprising:

(a) a gridwork system including a plurality of support members interconnected to one another to form a matrix having a plurality of apertures and secured solely to a plurality of walled surfaces of a room, wherein ones of said support members exhibit a right angled cross sectional shape and others of said support members exhibit a T cross sectional shape, wherein a plurality of relatively long T shaped support members are mounted in spanning parallel relation to opposite ones of said walled surfaces and wherein a plurality of relatively shorter T shaped support members are transversely supported between said spanning T members;

(b) a plurality of rib members exhibiting an exposed lower surface identical to a lower surface of each of said T shaped support members, wherein each of said rib members is sized to mount in arched relation between adjacent ones of said spanning T shaped support members and wherein each rib member includes indexing means secured to an upper surface; and (c) a plurality of translucent panels sized to mount within the apertures of said gridwork relative to said indexing means and over said arched rib members.

7. Apparatus as set forth in claim 6 including a plurality of flourescent light fixtures mounted in the space between said ceiling system and a ceiling surface of said room.

* * * * *